United States Patent [19]

Weinar

[11] 3,978,626

[45] Sept. 7, 1976

[54] REMOVABLE WIRE TIE FOR ADHESIVE APPLIED WALLBOARD INSTALLATION

[76] Inventor: Roger N. Weinar, 196 Greenfield Drive, Tonawanda, N.Y. 14150

[22] Filed: May 14, 1975

[21] Appl. No.: 577,215

[52] U.S. Cl. ..... 52/127; 249/215; 52/647; 52/746

[51] Int. Cl.[2] ..... E02D 35/00; E04B 1/00

[58] Field of Search ..... 52/127, 483, 489, 647, 52/746, 712, 122, 741; 249/215, 38, 40; 100/25

[56] References Cited

UNITED STATES PATENTS

| | | | |
|---|---|---|---|
| 1,175,163 | 3/1916 | Maier | 52/746 |
| 2,190,700 | 2/1940 | Colt | 249/40 |
| 2,375,648 | 5/1945 | Hamilton | 249/40 |
| 2,472,756 | 6/1949 | Nelsson | 52/127 |
| 3,588,082 | 6/1971 | Chiffoleau | 52/489 |

*Primary Examiner*—Ernest R. Purser
*Assistant Examiner*—Robert Farber

[57] ABSTRACT

Two abutting predecorated gypsum wallboards, being adhesively affixed to preformed sheet metal framing members, such as studs, are temporarily held firmly against a stud, which is disposed behind the joint between the two boards, by means including an elongate flat block disposed against the face of the board edges, a tie wire and a small arcuate wire guide, with the tie wire extending from one end, near the outer face of the block, to between the wallboard edges, through one hole in the stud, around the arcuate guide, back through another hole in the stud, out between the wallboard edges to the other end, also near the outer face of the block. The two wire ends are arranged to urge the block tightly against wallboard, when the two wire ends are twisted together. Removal of the wire and block involves cutting one leg of the wire, adjacent the block, and then pulling the wire out of the wall by pulling on the other wire leg.

10 Claims, 5 Drawing Figures

REMOVABLE WIRE TIE FOR ADHESIVE APPLIED WALLBOARD INSTALLATION

BACKGROUND OF THE INVENTION

1. Field of the Invention

This invention relates to conventional metal stud and wallboard construction, and the common practice of using an adhesive to invisibly secure the wallboard panels to metal studs or to metal furring channels. Metal framing members are preferred over wood framing members in commercial construction because they are easily installed and they are fireproof.

2. Prior Art

Various methods are used to secure wallboard panels to sheet metal framing members. The most common practice is the use of self-drilling, self-tapping sheet metal screws. This construction method requires a decorative cover or batten strip to conceal the unsightly screw heads on the exposed panel surfaces.

Another construction method utilizes an adhesive to invisibly secure wallboard panels to the metal studs. This method eliminates the costly batten strips and provides a more aesthetically pleasing wall. In the adhesive applications, a more uniform finished wall is obtained when the wallboard panels are held firmly against the metal studs until the adhesive sets. Wood braces or kickers are often used to apply external pressure to the panels, some applicators will pre-bow or arch the panels prior to installation to help insure uniform adhesive contact. Both methods are time consuming and often twist the metal studs, causing adhesive gaps, uneven and loose joints in the completed wall.

SUMMARY OF THE INVENTION

An object of this invention is to provide an improved construction method for adhesive applied wallboard panels.

A particular object of this invention is to provide an improved means of temporarily tying wallboard panels to standard metal framing members until adhesive sets.

It is an additional object of this invention to provide a quickly and easily installed wire tie to rigidly align metal stud runners and wallboard panels in a coplanar relationship until the adhesive sets.

Another object of the invention is to provide a temporary wallboard tie, utilizing a thin wire loop to minimize obstruction of wallboard joint closure.

Another object of the invention is to provide a wallboard tie to rigidly secure any wallboard, regardless of panel thickness.

Another object of the invention is to provide a wire tie with a guide to control and direct the wire within the wall cavity.

Another object of the invention is to provide a wire tie that may be quickly and completely removed from the completed wall assembly.

Another object of the invention is to provide a cooperating pressure block to distribute the compressive force of the tie uniformly along the wallboard joint.

Another object of the invention is to provide metal framing members that have been punched to provide holes to accomodate the wire ties.

Other and further objects and advantages of this invention will become apparent to those skilled in the art from a consideration of the following specification when read in conjunction with the annexed drawings.

DESCRIPTION OF THE DRAWINGS

In the accompanying drawings.

DESCRIPTION OF THE PREFERRED EMBODIMENTS

Figure 1:
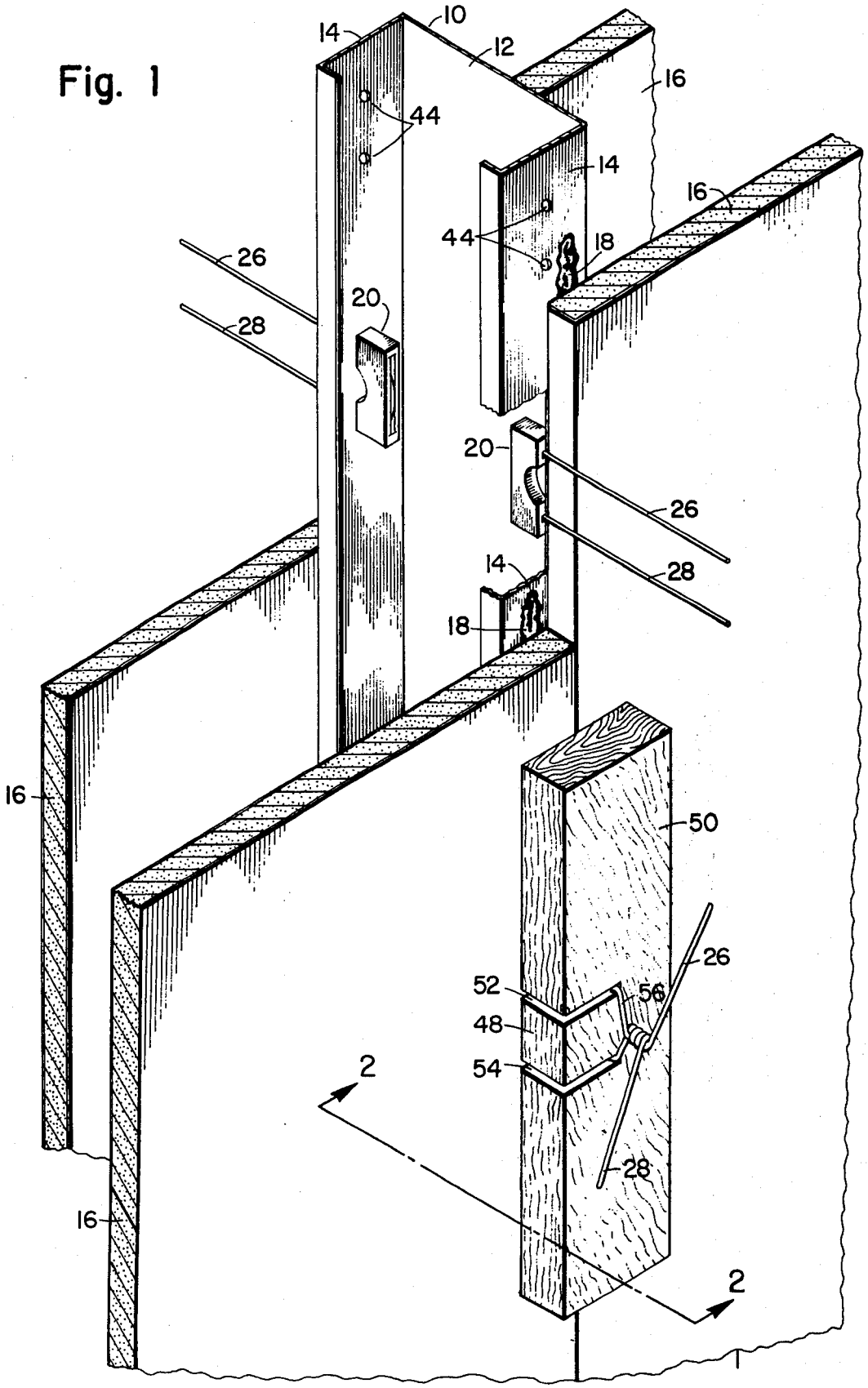
FIG. 1 is an isometric view of a metal stud and gypsum board structure, embodying the present invention, with various portions shown in various stages of completion of construction.

Referring to the drawings in more detail, and initially to FIG. 1, a conventional framing member, such as wall stud 10, comprised of a generally upstanding planar web portion 12 and a pair of flange portions 14 extending laterally outward, perpendicular to said web 12, is shown in operative position in a partition wall. Conventional wallboard panels 16 are employed to provide wall surfaces. Wallboard panels 16 may be of any of the well-known compositions such as plasterboard, fiberboard, vinyl covered gypsum board and the like.

It is a common practice to permanently secure wallboard panels 16 to conventional metal studs 10 by dispensing continuous beads of adhesive 18 along the exposed flange 14 of the stud 10 and to press the wallboard panels 16 against the adhesive covered studs in an abutting edge-to-edge relationship forming a continuous wall.

Heretofore, it has been the practice to use external braces or kickers of various fabrication, to keep the wallboard panels in contact with the metal studs until the adhesive sets. External bracing, however, will often cause the metal studs to twist, preventing a satisfactory adhesive bond, resulting in loose and uneven wallboard joints.

To prevent these disadvantages, this invention provides a wallboard tie assembly 20 to temporarily secure the wallboard panels 16 to the metal studs 10 as shown in FIG. 1.

Figure 3:
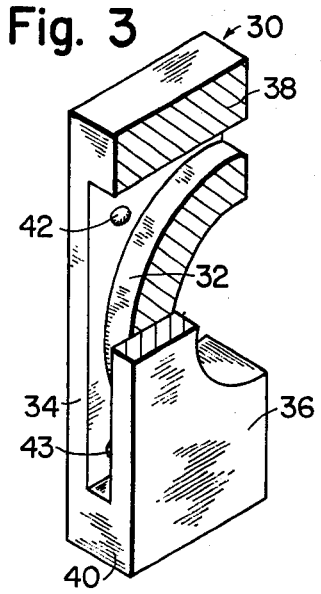
FIG. 3 is a magnified isometric, partially cut-away, illustrating the wire guide portion of the tie assembly.
Figure 4:
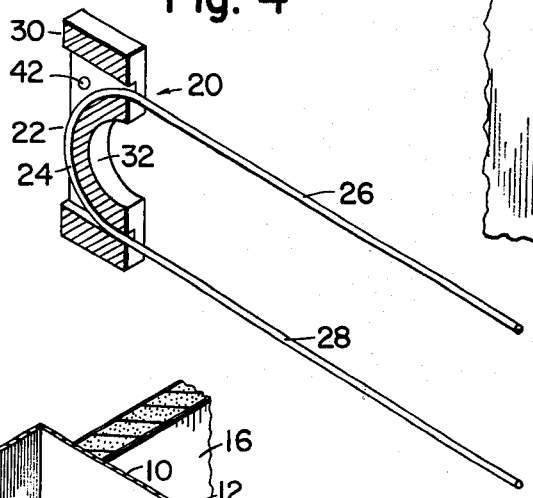
FIG.4 is an isometric view of the tie assembly with the wire guide portion cut-away to show the entire wire stirrup portion.

The components of the tie assembly are best shown in FIGS. 3 and 4.

FIG. 3 illustrates an enlarged view of the wire guide 30 portion of the tie assembly 20. Wire guide 30, molded of a semi-rigid plastic material, is illustrated cut-away to expose the arcuate interior portion 32, disposed within a substantially rectangular wall arrangement. Two opposing major walls 34 and 36, and two minor walls 38 and 40 confine the lateral mobility of the wire bight to the arcuate interior portion 32 of the wire guide 30. Opposing major walls 34 and 36 are provided with embossed projections 42 and 43 to obstruct the backward movement of the wire after assembly.

FIG. 4 illustrates the completed tie assembly 20, and is cut-away to expose the interior of the plastic wire guide 30. Legs 26 and 28 of the wire stirrup 22 are directed through the plastic guide 30 until the wire bight 24 is radially engaged by the arcuate interior 32 of the guide 30. Embossed projections 42 and 43 are deflected by the passing of the wire bight 24 and recover to hold the plastic guide 30 on the wire bight 24, completing the tie assembly 20.

Referring to FIG. 1, a typical wall installation begins by erecting metal stud framing members 10 vertically between floor and ceiling channels (not shown). Holes 44 must be provided through the flange 14 of the stud 10 to accommodate the wire tie assembly 20. Two holes for each tie, approximately one inch apart, are field applied to conventional metal framing members with a punch, drill or awl. The metal framing members could be factory punched to eliminate this field operation.

The wire tie assemblies 20 are then installed at suitable vertical intervals (two or three ties per side of each stud is usually sufficient) by inserting the wire legs 26 and 28 through a pair of holes 44 from inside the metal stud 10 so wire legs 26 and 28 are extending outward from the stud flange 14.

Adhesive is then dispensed from a suitable applicator and disposed along the entire exposed stud flange 14 in the form of two spaced parallel beads 18.

Figure 2:
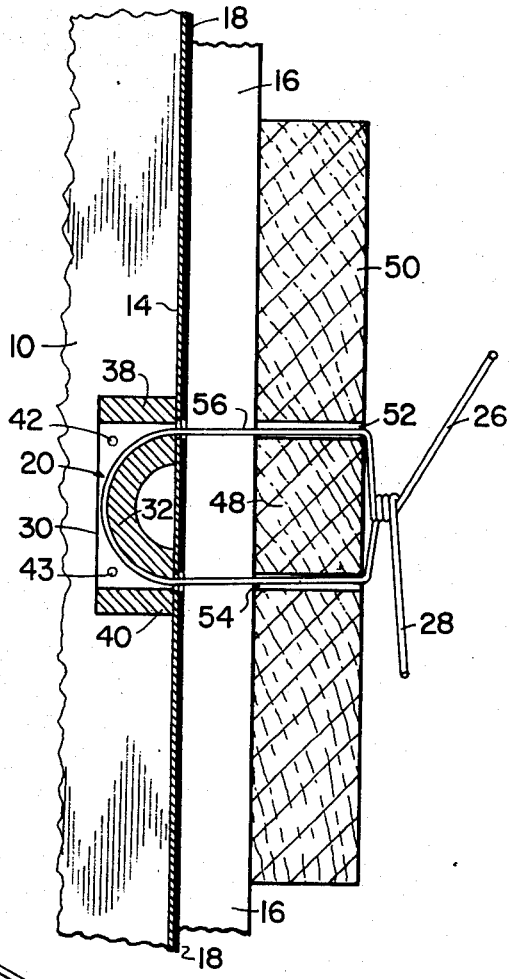
FIG. 2 is a vertical cross-section of the lower portion of FIG. 1, taken generally along the line of 2—2 of FIG. 1.

Wallboard panels 16 are then consecutively placed in contact with the adhesive covered metal stud members, each wallboard edge falling on approximate center of a metal stud flange 14, permitting wire legs 26 and 28 to protrude through the wallboard joint and engage an arbor 48 of a pressure block 50 as shown in FIGS. 1 and 2.

Pressure block 50 is best illustrated in FIGS. 1 and 2. The elongated, substantially square block 50 of wood or other suitable material, has a pair of parallel slots 52 and 54, continuous from opposing planar surfaces, extending laterally inward from one side of block 50, terminating slightly past block 50 center, creating arbor 48.

Figure 5:
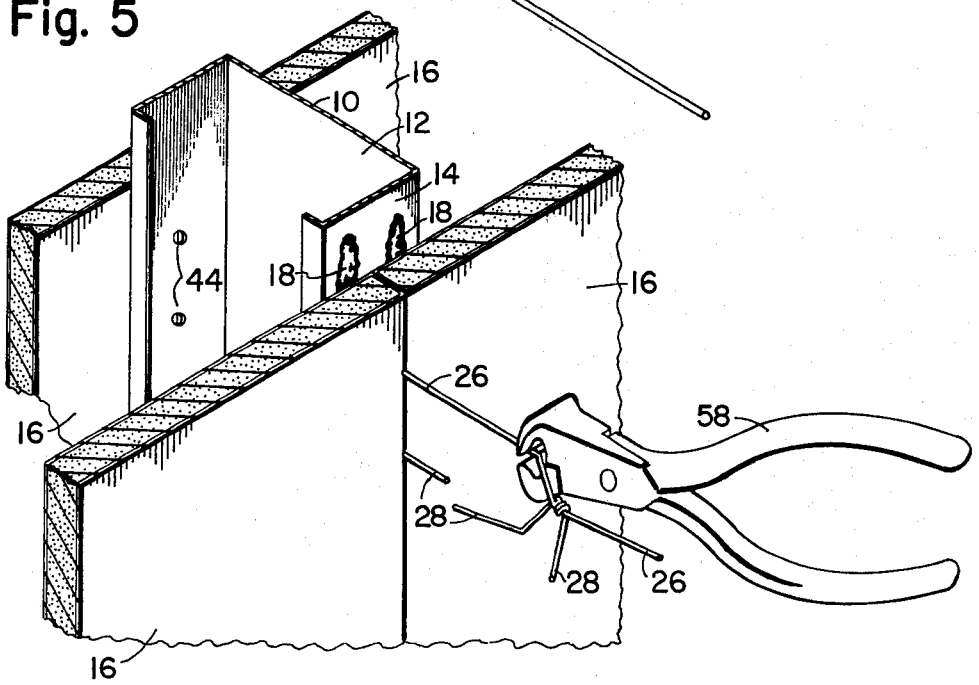
FIG. 5 is an isometric view of a portion of a wall structure previously constructed with the wire tie assembly, as in FIG. 1, to illustrate the removal of the tie wire from the completed wall structure.

By enwrapping wire legs 26 and 28 about arbor 48 and twisting them together with pliers, or any other suitable tool, a continuous wire loop 56 is formed about the arbor 48, through the wallboard joint, and about the wire guide 30, as illustrated in FIG. 2. By using pliers to twist wires 26 and 28 about pressure block arbor 48, a strong compressive force is distributed to the wallboard joint, uniformly along the entire length of the pressure block 50. The joint is allowed to remain in this state of compression about twenty four hours, or until the adhesive sets. The wallboard ties 20 may then be removed from the joint by severing one wire leg 28, thus interrupting wire loop 56 causing pressure block 50 to fall away as illustrated in FIG. 5. Pliers 58 are then used to draw the severed wire loop from the wallboard joint. By applying a pulling force to leg 26, the other free leg 28 is drawn through the joint into the wall cavity, around the wire guide 30, and out of the wall cavity along the path of wire leg 26. Wire guide 30, now free of the wire, is lost within the wall cavity. The wire loop is destroyed when severed. The pressure block 50 may be reused with new tie assemblies 20.

Having completed a detailed disclosure of the preferred embodiments of my invention so that those skilled in the art may practice the same, I contemplate that variations may be made without departing from the essence of the invention or scope of the appended claims.

I claim:

1. In combination, an elongate wall framing member and an arcuate tie wire support, said framing member having a substantially flat front face, a pair of spaced-apart holes extending through said face, an arcuate rigid support surface disposed within said framing member, with the two ends of said arcuate surface being disposed immediately behind the respective two holes of said pair of holes, and a wire disposed with an arcuate portion around said arcuate surface and extending outward through said two holes, whereby said wire is suitably held in place when equal tension is applied to the ends of said wire and is readily removable when light tension is applied to only one end of said wire.

2. A drywall construction comprising, in combination, a framing member and a tie wire as defined in claim 1, and further comprising a pair of wallboards, said wallboards being disposed in coplanar, edge-abutting relationship forming a wallboard joint therebetween, said wallboard joint being disposed substantially centered over an elongated face of said wall framing member whereby an edge portion of the back face of each of said wallboards is disposed over said framing member elongate face, an adhesive material disposed between said wallboards and said framing member, and a rigid block held firmly against the edge portions of the front face of said wallboards, said rigid block being held against said wallboards by said tie wire, said tie wire extending from said framing member through the joint between said wallboards and outward of said wallboards whereat said legs are tied to hold said block.

3. The method of affixing wallboard to a framing member comprising the steps of forming a pair of holes in a face of said framing member, forming anarcuate supporting surface within said stud extending from one said hole to the other said hole, placing a tie wire around said arcuate surface with one leg of said wire extending out from each of said two holes, disposing adhesive on the face of said framing member, placing two wallboards in coplanar relationship with edge of the back face of each disposed against said adhesive and with the two wire legs extending through the joint between said wallboards, placing a rigid block against the outer face of said two wallboards at said joint, tying said two wire legs about a portion of said block whereby said block is held firmly against said wallboards, leaving said block tied and held firmly for a period of time sufficient for said adhesive to acquire a firm bond of said wallboard to said framing member, separating the said two wire legs, applying tension to only one of said two legs whereby said other leg is drawn through said framing member holes and around said arcuate surface, and removing said block and said wire.

4. A drywall construction comprising, in combination, a framing member and a tie wire as defined in claim 1, wherein said arcuate rigid support surface consists of an arcuate interior portion disposed within a substantially rectangular wall arrangement to confine the lateral mobility of said wire.

5. A drywall construction as defined in claim 4, wherein opposing major walls of said rectangular wall arrangement are provided with embossed projections to obstruct the backward movement or removal of said wire from said arcuate support surface.

6. A drywall construction comprising, in combination, a framing member, a tie wire and a rigid block as defined in claim 2, wherein said rigid block is an elongated substantially square member of wood or other suitable rigid material, has a pair of parallel slots, continuous from opposing planar surfaces, extending laterally inward from one side of said block, terminating slightly past said block center, creating an arbor about which said wire may be enwrapped.

7. The combination as defined in claim 1 wherein said arcuate surface has an arcuate curvature of about one inch diameter.

8. The combination as defined in claim 1 wherein said arcuate surface has a diameter of about one inch, said two ends of said arcuate surface are spaced apart about one inch and said two holes are also spaced apart about one inch, whereby a wire disposed around said arcuate surface does not develop a form retaining bend thereat.

9. The combination of claim 1 wherein said arcuate tie wire support has means on each side of said arcuate surface which confine the lateral mobility of said wire.

10. The combination of claim 9 wherein said confining means consist of opposing walls, and said walls have embossed projections to obstruct the backward movement or removal of said wire from said arcuate said support surface.

* * * * *